United States Patent [19]

McAnespie et al.

[11] 4,079,877

[45] Mar. 21, 1978

[54] WEB-DRYER THREADING APPARATUS HAVING ANTI-CENTRIFUGAL STRUCTURE

[75] Inventors: Donald McAnespie; Zoltan Beke, both of La Salle, Canada

[73] Assignee: Midland-Ross Corporation, Cleveland, Ohio

[21] Appl. No.: 757,775

[22] Filed: Jan. 7, 1977

[51] Int. Cl.[2] ..... B65H 17/34; G03B 1/56

[52] U.S. Cl. ..... 226/92; 34/120; 162/255; 214/1.7

[58] Field of Search ..... 226/92, 91; 214/1.7; 34/120, 117, 118; 162/255, 193; 198/729, 850

[56] References Cited

U.S. PATENT DOCUMENTS 3,508,342 4/1970 Levtchouk et al. ..... 34/120

3,707,743 1/1973 Marchal ..... 34/120 X

*Primary Examiner*—Bruce H. Stoner, Jr.

*Attorney, Agent, or Firm*—Woodrow W. Portz

[57] ABSTRACT

Disclosed herein a web-treating system equipped with web-threading apparatus having as principal structure, pulleys in endwise coaxial relation with web-conveying rolls, an endless drive cable extending over the pulleys, and a web-tail gripping device with transversely elongate elements thereof supported in the web path by the drive cable. Such elements and the pulleys are especially constructed to engage in an interlock condition as the elements traverse portions of the web path around the rolls so as to prevent the elements from centrifugally swinging away from the web path.

7 Claims, 13 Drawing Figures

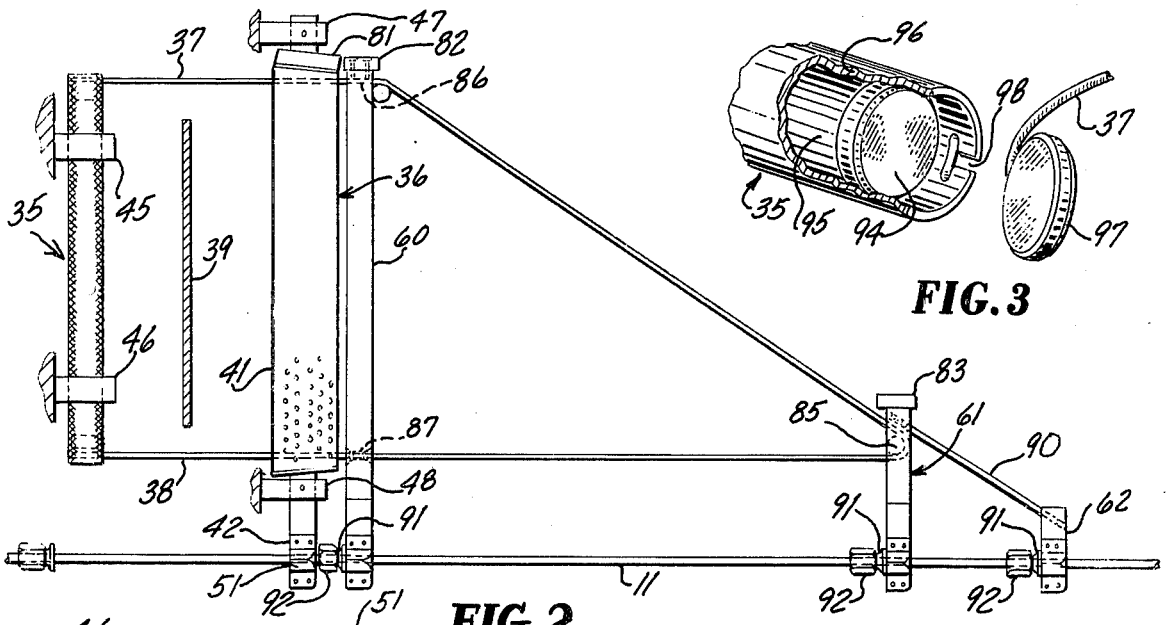
FIG. 2
FIG. 3
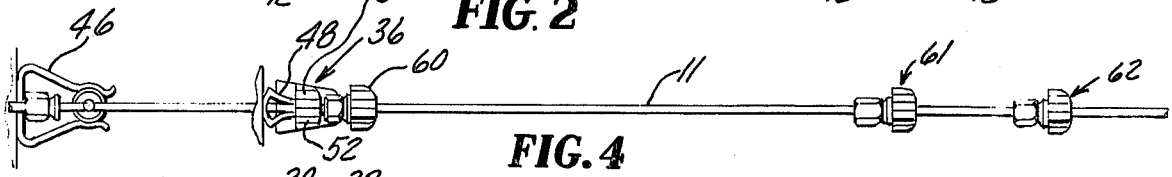
FIG. 4
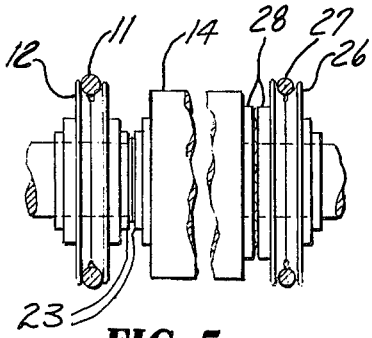
FIG. 5
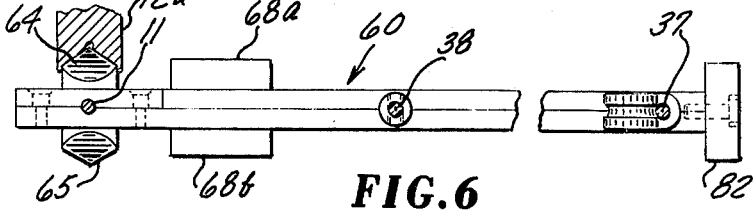
FIG. 6
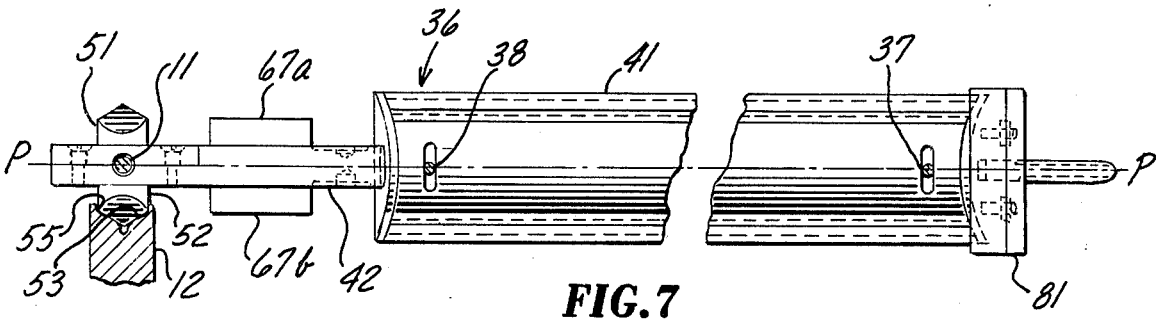
FIG. 7
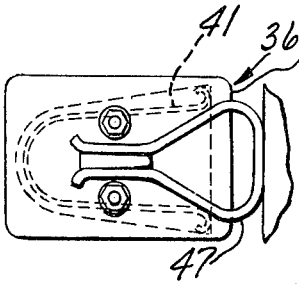
FIG. 8

WEB-DRYER THREADING APPARATUS HAVING ANTI-CENTRIFUGAL STRUCTURE

BACKGROUND OF THE INVENTION

In a typical paper or pulp treating machine, the web advances over a series of rolls arranged to form a zigzag web path. In the presently preferred lacing system for such machines, a pair of cables are supported in parallelism with the web path at opposite ends of the rolls by pulleys in adjacent coaxial relation with the ends of the rolls. One cable is a drive cable for the rolls and is supported on pulleys rotatably connected with associated rolls by override clutches. The drive cable is driven by, e.g., a motor which can accelerate the rolls from rest to operating speed during a lacing operation. The pulleys at the other end of the rolls are free-wheeling and support a second cable which has the function of supporting one end of a bar extending transversely of the web path from one cable to the other. The second cable is driven by the drive cable by a cross shaft mounting sheaves in contact with both cables. The bar has the function of leading the other elements of the lacing equipment and the advancing tail of the web through the machine. Before initiation of a lacing operation, the unloaded free-wheeling rolls would be at rest. It is necessary to connect a tail of the web with the lacing apparatus and energize the drive cable to accelerate the rolls to operating speed while lacing the web through the machine.

Because of the web path widths on the order of 12 feet or more, the bar must be constructed strongly enough to resist bending under centrifugal force as it travels around the roll. Bars in use commonly weigh 75 pounds.

Occasionally, one cable is caused to lag the other to place the bar on a bias with respect to its normally perpendicular alignment to the web path. This can lead to disastrous results as the bar attempts to go around the rolls. There is the hazard of the cables jumping the pulleys and a safety hazard to personnel in the vicinity of rapidly moving unguided parts. Hence, some of the more obvious disadvantages of the principal lacing apparatus in use in view of the present invention relate to operating safety, mechanical complication, loss of time to accelerate unloaded rolls to operating speed, speed synchronization of the two cables, lost time in maintaining proper adjustments, excessive weight of parts, and an increasing difficulty to cope with increased web and roll speeds.

In addition to overcoming the above-named disadvantages, objects of the invention are: to provide lacing apparatus for web handling machinery which enables clamping of the web without the necessity for forming a web tail by manual tearing; to provide threading apparatus which avoids the necessity for breaking or severing the web to provide a tail; to provide apparatus of lower cost than that now in general use; to provide threading apparatus which may advance around rolls defining the web path without being centrifugally urged out of the path; and to provide the lacing mechanism which can be driven from at least one of the rolls independently of the other conventional roll driving cable.

SUMMARY OF THE INVENTION

This invention provides threading apparatus for webs supported over a series of rolls and consists generally of a plurality of pulleys, each located in coaxial juxtaposed and rotatably independent relation with the end of each web-supporting roll; a drive cable laced around the pulleys in parallel relation with the web path; a clutch between one of the pulleys and the adjacent roll; and a device carried by the single cable for seizing and advancing the tail of the web upon actuation of the clutch.

One of the most important features of the web-gripping device is integral lug structure of each of those transversely elongate elements of the device connected to the drive cable of such cross section as to substantially fit the crosswise contour of the pulley grooves as each element passes around a pulley. The element thus interlocks with the pulley grooves in a manner that restrains the element from pivoting about its cable-supported end radially away from the roller surface as it passes around each roll.

Another important feature of the invention is structure of the web-gripping device which permits receiving of the full-width advancing broken end of the web through a temporarily open portion of the web-gripping device until a tail of partial web width can be formed. Thereafter portions of the device may be reconnected in surrounding relation with the advancing tail. Specifically, the device includes a dihedral or shed-shaped receiver slidably supported on two parallel cable portions terminating in a web-seizing bar. When the receiver and the bar are supported in fixed spaced positions in the machine prior to a threading operation, one of the cable portions is disconnected from the bar to allow one side of the unslitted web to pass between the receiver and the bar. A web slitter is thereafter applied to the web to cut the tail no wider than the spacing of the cable portions when attached to the bar. The free cable end is then connected with the seizing bar to encircle the moving tail. Operation of the above-mentioned clutch causes the drive cable to act on the device to jerk the seizing bar out of the fixed releasable detent, engage the tail and then enter the receiver to thus entrap the tail therebetween. The adjoined receiver and seating bar is then jerked away from the releasable detent of the receiver. In this manner, threading of the web is initiated.

BRIEF DESCRIPTION OF THE DRAWING

FIG. 2 is a fragmentary view in plan of a portion of the web-threading apparatus illustrating primarily the web-tail gripping device.

FIG. 3 is a fragmentary, partly broken-away perspective view of the web-tail seizing bar with the terminous of one of the tow cables moved to a detached position.

FIG. 4 is a side elevation of the apparatus shown in FIG. 2.

FIG. 5 is a fragmentary view of a portion of a web-advancing roll and adjacent coaxial pulleys of the threading apparatus.

FIG. 6 is a front-shortened view of a cable clamping and spacing bar of the web-tail gripping apparatus.

FIG. 7 is a front shortened view of a web-seizing bar receiver showing also its relationship with the drive cable, tow cables for the web-seizing elements, and a support pulley for the drive cable.

FIG. 8 is a right end view of the receiver as shown in FIG. 7.

DESCRIPTION OF THE PREFERRED EMBODIMENT

Figure 1:
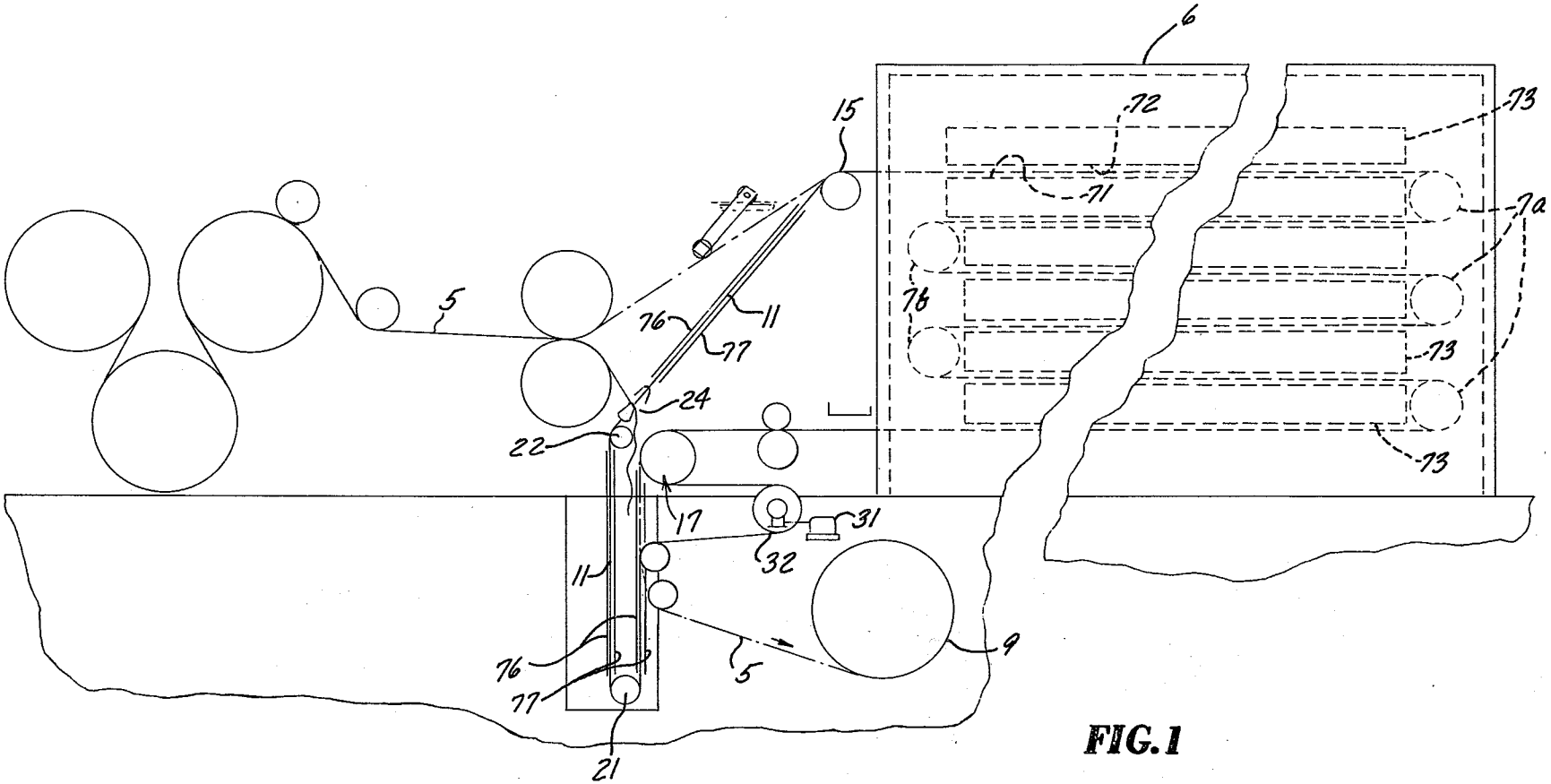
FIG. 1 is a schematic view in elevation of a web-processing system incorporating the web-threading apparatus of the invention.
Figure 9:
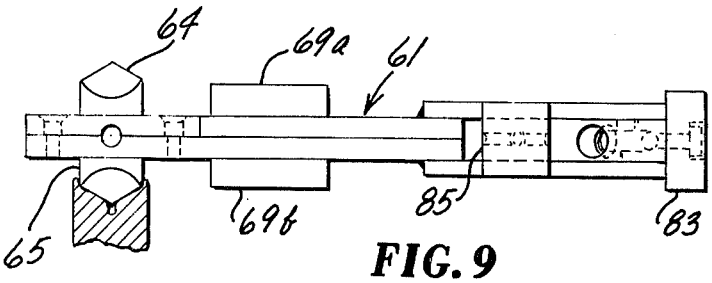
FIG. 9 is a front view of a tow bar used as a leading anchor for the tow cable.
Figure 10:
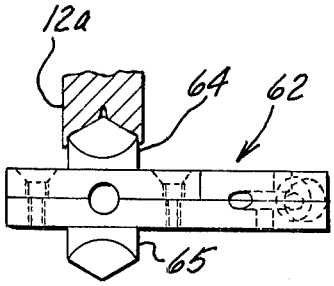
FIG. 10 is a front view of an auxiliary lead bar for furnishing additional support of the tow cable bar of FIG. 9.
Figure 11:
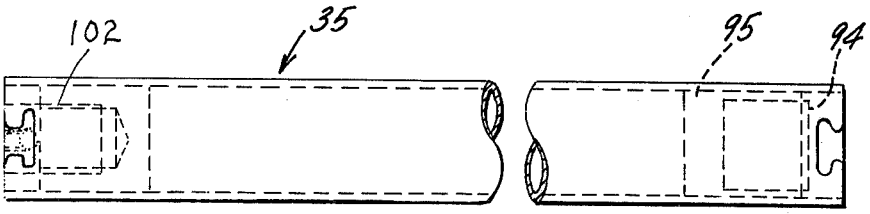
FIG. 11 is a front view of a web-seizing bar adapted to be received in the receiver of FIG. 7.

FIG. 1 illustrates schematically machinery for processing a web 5 including a dryer 6 having web-supporting rolls 7*a* and 7*b* which forward the web in a sinuous path toward a takeup roll 9. Because of the virtual impossibility of manually threading a web through the dryer, at least that part of the processing route including the dryer is equipped with web threading equipment having a portion of its endless path in parallelism with a selected part of the processing route. FIG. 1 shows an endless path for a cable 11 which is supported on a pulley coaxially adjacent each roll, such as pulley 12 of FIG. 5 shown adjacent to a web supporting roll 14. It is to be noted that the cable extends in concurrency with the web 5 starting with a guide roll 15 and ending with a guide roll 17 located at a point just prior to storing the web 5 in the takeup roll 9. The cable departs from the web path at roll 7 to continue in its own endless path around rolls 21, 22.

A clutch 23 is mounted between one of the rolls close to the threading station 24 and the corresponding coaxial pulley for supporting the cable 11 in order that an operator may engage the clutch to initiate movement of the cable 11 simultaneously with the act of introducing a web tail between web-tail seizing elements of the threading apparatus.

Since it is desirable to avoid start-up inertia and the acceleration time incidental to bringing the rolls to be laced to operating speed embraced by the drive cable 11, provision is made for driving the rolls within the threading system until they can be threaded. Accordingly, a roll propulsion system is provided for the rolls to be threaded comprising pulleys in coaxial relation with each roll at the end of the roll opposite that which receives a pulley for carrying the drive cable 11 for driving the threading apparatus. These pulleys are typified by pulley 26 of FIG. 5 for supporting a roll driving cable 27. Each pulley 26 is rotatably connected to its respective coaxial web-supporting roll by an overrunning clutch 28 which behaves in principle similarly to the clutch commonly used on bicycles with pulley 26 analogous to the bicycle rider. The cable 27 may be driven by any suitable driving mechanism such as the motor 31, and drive pulley 32. When the web handling rolls are threaded and the web is being wound onto the takeup roll 9, the cable drive system may be de-energized and the cable 27 with its supporting pulleys 26 allowed to come to rest through operation of the override clutches 28. Once the web handling system is threaded, the drive cable 11, all pulleys associated therewith, and other elements of the threading system may also be allowed to come to rest.

The essential function of the drive cable 11 is to support elements of a web-tail seizing device comprising as, the actual web-tail seizing components, a cylindrical bar 35 of roughened or knurled outer surface, and a receiver 36 which in operation is approached by the bar 35 while cable portions 37, 38 slide forwardly through the receiver to enclose the bar 35 with the web tail 39 entrapped between the inner surface of the generally dihedrally-shaped shroud 41 and the bar 35. The receiver 36 has a bar portion 42 apertured as shown in FIG. 8 to slidably receive the drive cable 11. As the cable 11 and the bar 35 move forward to entrap the tail 39, the cable slides readily through the bar portion 42.

In the inactivated condition of the threading apparatus, the web-tail seizing elements 35, 36 are stored in fixed position within the web-treating equipment. For example, the web-tail seizing bar 35 is received in fixed spring clamps 45, 46 from which it may be releasably detached upon activation of a pulley clutch controlling the movement of cable 11. The receiver 36 is supported in the basic machine in a similar manner by means such as fixed spring clamps 47, 48. From a description below of the manner in which cable portions 37, 38 are supported, it will be understood that as cable 11 commences its movement, corresponding movement of the bar 35 occurs until it has moved along with the tail 39 into the interior of the receiver 36. Continued draft of the cable portions 37, 38 on the bar 35 carries the receiver 36 out of the grip of its detent clamps 47, 48 and threading of the web roll system commences.

As an important feature of the invention, the bar portion 42 of the receiver comprises lugs 51, 52 which extend perpedicularly from the normally horizontal plane P—P of the receiver in a way that is common to other elements of the web-tail seizing device which attach cantilever style to the drive cable 11. Each lug 51, 52 terminates away from the center plane of the bar portion through which the cable 11 extends as a wedge surface which has a profile from the front or the rear of the lug which is complementary to a transverse cross section of the cable-receiving groove 53 of any of the pulleys traversed by the cable 11. From FIG. 5 it will be noted that the cable normally rests within the groove 53 but as one of the elements of the web-tail seizing device pass over the pulley, the cable is raised away from the pulley groove because of engagement of the lug with the surface of the groove as shown in FIG. 6. The cable 11 is ordinarily held to the goove surfaces at high tension exerted by the idler pulley 12. However, as the lug 51 or 52 passes over the pulley, the tension on the cable 11 is even greater.

As the receiver follows the web path around a web-supporting roll, the end of the receiver away from the pulley 12 is subjected to centrifugal force which tends to pivot the right end portion of the receiver, as viewed in FIG. 7, away from the roll. Such centrifugal force is counteracted by leverage force about point 55 at which a corner edge of the lug engaging the point 55 creates a fulcrum for the entire receiver. As a result, the radial force created by the tension on cable 11 applied to a lever arm equaling the distance between the cable and point 55 opposes the effect of centrifugal force as produced in a lever are extending from point 55 to some point of representing a center of gravity of the receiver at which centrifugal force tending to tilt the receiver outward is substantially concentrated.

Cable-clamping bar 60, cable-anchor bar 61, and auxiliary lead bar 62 are similarly provided with lugs 64, 65 which oppose centrifugal forces tending to swing any of these bars outwardly away from the portions of the web path extending around the web-supporting rolls.

In reference to support of the elements of the web-tail seizing apparatus supported on the cable 11, the above description refers only to structure for maintaining elements of the threading apparatus which project transversely from the cable 11 within the web path as such elements pass through portions of the web path extending around the web-supporting rolls.

As a feature of this invention, structure is provided also for maintaining such elements in close proximity to the web path along rectilinear portions thereof extending between the various web-supporting rolls and in those portions of the drive cable path which are separated from the web path for the purpose of providing the continuous or endless circuit for the threading apparatus. Accordingly, the receiver 36, the cable-clamping bar 60, and the tow bar 61 have inboard rubbing blocks 67*a* and 67*b*, 68*a* and 68*b*, and 69*a* and 69*b*, respectively, attached thereto. In passing through the dryer 6, these blocks are of such thickness as to pass between surfaces 71 and 72 of adjacent air nozzle headers 73 at normally small clearance but to engage said surfaces if the cable 11 and the elements of the threading device deviate appreciably from the plane of the web path. Along rectilinear portions of the cable path outside the dryer, the rubbing blocks pass between parallel spaced rails 76, 77 spaced to retain elements of the web-threading apparatus in any plane containing the cable 11 perpendicular to a plane containing the pulleys 15, 21, 22 etc. for supporting cable 11.

Additional outboard rubbing blocks 81, 82 and 83 are capscrewed to the outboard ends of the receiver 36, cable-clamping bar 60, and the tow bar 61, respectively, to stabilize the outboard ends of these members as they pass between the headers 73. The various figures indicate that the dimension of rubbing blocks 81, 82, 83 perpendicular to the web path is the same as that through cooperating pairs of inboard rubbing blocks, such as blocks 68*a* and *b*. The rubbing blocks are constituted preferably of a polymeric resin which is non-abrasive and slippery with respect to metal.

Figure 13:
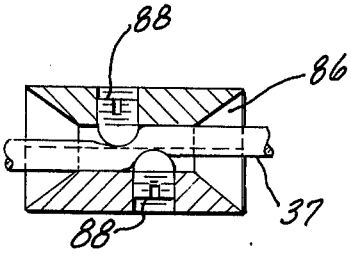
FIG. 13 is a cross section of the cable-clamping bar of FIG. 6 illustrating anti-slip structure for securing a tow cable with respect to the bar.

As disclosed, tow cable portions 37, 38 constitute a single cable which extends around an anchor pin 85 secured in the cable anchor bar 61. The cable portions are secured in non-slip arrangement with respect to the bar 60 within aperture 86, 87 thereof as shown in FIG. 13 by set screws 88. The short auxiliary lead bar 62 is connected by the short length biased cable 90 to the outboard end of the tow bar 61 to provide additional support to the threading apparatus. In order that the three bars 60, 61 and 62 shall remain non-rotatable with respect to the cable 11, each bar has fixed to it an exteriorly threaded longitudinally tapered and split mandrel 91 surrounding the cable on which a nut 92 can be tightened to secure the bar at a fixed point along the cable.

Another important feature of the invention is illustrated in FIG. 3 wherein an end portion of the bar 35 is broken away to expose a magnet 94 secured to a cartridge 95 fixed within the outer tubular wall 96 of the bar. A disc 97 of magnetic material such as steel is secured to a cable portion 37 and is ordinarily received within the end of the bar 35 against the magnet 94 with the cable portion 37 received in the slot 98. The disc and the bar 35 are shown in this condition in FIG. 2. Such structure may be advantageously used at the beginning of the threading operation by having the disc removed from the rod as shown in FIG. 3 whereupon a side portion of the web is inserted into a space between the rod 35 and the receiver 36, and thereafter a slitting tool is applied to the web to form a tail of width receivable into the space between the rod and the receiver and the spacing afforded therein by the cable portions 37, 38 as shown in FIG. 2. As the threading progresses, the width of the amount of web being threaded through the web processing equipment may be increased gradually by adjustment of the slitting tool until full width is being passed through the machinery.

Figure 12:
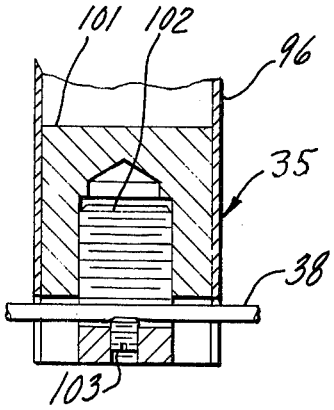
FIG. 12 is a fragmentary axial cross section of one end of the web-seizing bar of FIG. 11 showing structure for receiving a tow cable.

FIG. 12 illustrates the end portion of the bar 35 to which the cable portion 38 is attached. The tube 96 has fixed therein an internally bored cartridge 101 providing threaded relation with a threaded plug 102. The plug and the tube have transverse apertures or slots in registry which receive the cable portion 38. A set screw 103 in threaded relation with the plug tightens against the cable portion 38.

What is claimed is:

1. Apparatus for threading web-treating apparatus comprising web supporting rolls, the apparatus comprising:

rotary pulley means in rotatably independent coaxial and adjacent relation to each web-supporting roll, the pulley means for each roll having a cable-receiving groove;

a drive cable supported in the grooves of said pulley means in parallel relation with a web path over the rolls;

driving means for selectively driving, or not driving, the cable at roll surface speed;

web gripping means for receiving and seizing a tail of a web conveyed to said rolls, said web gripping means comprising at least one bar connected with said drive cable to extend transversely with respect to said cable and the web path substantially along the plane of said path;

lug means in fixed relation with the bar projecting from a portion thereof connecting with said cable perpendicularly in respect to said web path and being of a contour complementary in cross section to that of a transverse cross section of said pulley means grooves whereby each lug means positions itself in the groove of each pulley means it engages to restrain movements of said bar centrifugally away from said path.

2. The apparatus of claim 1 wherein:

said driving means is one of said rolls and clutch means between said roll and the one of said pulley means in adjacent coaxial relation therewith.

3. The apparatus of claim 1 wherein said web gripping means comprises:

a relatively short tow bar having a fixed connection with the drive cable and projecting laterally from said cable in the transverse direction of said web path into said path;

a relatively long cable-clamping bar spaced from said tow bar along said cable in the rearward or trailing direction of said web path, having a fixed connection therewith, and projecting laterally from said cable into said web path;

cable means comprising two strands anchored on said tow bar and extending divergingly therefrom in said rearward direction into fixed connections with said clamping bar at a spacing in the transverse direction of the web path at least partly within the width of the web path;

a web-seizing bar receiver comprising a central shroud which opens divergingly rearwardly relative to web travel, and linearly aligned bar portions connected with, and extending in said transverse direction, from opposite ends of the shroud, said strands extending rearwardly through opposite end portions of the shroud in slip relation therewith, the bar portion nearest said drive cable having a slip connection with said cable;

a web-seizing bar having a length substantially that of said shroud adapting it to be received therein for engaging the inner surface thereof;

means for connecting opposite end portions of the web-seizing bar with portions of said strands extending rearwardly of the cable-clamping bar, said strand portions extending from said clamping bars in substantially equal lengths substantially greater than the front-to-rear width of said shroud;

said tow bar, cable-clamping bar, and receiver being provided with said lug means.

4. The apparatus of claim 3 comprising:

cable-gripping means fixed to said tow bar and said receiver holding the drive cable non-rotatable therein.

5. The apparatus of claim 3 comprising auxiliary support means for said tow bar comprising:

a lead bar shorter than said tow bar fixedly attached to a portion of said drive cable in spaced leading relation with said tow bar and extending in its lengthwise direction transversely to said tow cable and said web path;

taut cable means fixed to and connecting the lead bar with a portion of the tow bar more remote from the drive cable than its connection with said first-named cable means.

6. The apparatus of claim 3 comprising:

first fixed-position detent means in said web-treating apparatus for releasably supporting said web-seizing bar, second fixed-position detent means in said treating apparatus for engaging said bar portions of the receiver in spaced relation with said first detent means for supporting said bar and receiver in spaced positions for passage of web therebetween;

said web-seizing bar and said strand further from the drive cable comprising quick disconnect elements of a connection for coupling said strand to said web-seizing bar.

7. The apparatus of claim 6 wherein:

one of said elements comprises a permanent magnet and the other comprises a magnetically sensitive material, and one of said elements is telescopic within the other in said transverse direction.

* * * * *

UNITED STATES PATENT AND TRADEMARK OFFICE

CERTIFICATE OF CORRECTION

PATENT NO. : 4,079,877

DATED : March 21, 1978

INVENTOR(S) : Donald McAnespie and Zoltan Beke

It is certified that error appears in the above-identified patent and that said Letters Patent are hereby corrected as shown below:

In the Abstract, line 1, after "herein" insert --is--.

Column 3, line 31, "7" should be --17--.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*